US009457213B2

(12) United States Patent
Miller et al.

(10) Patent No.: US 9,457,213 B2
(45) Date of Patent: Oct. 4, 2016

(54) SPRINKLER DEFLECTOR

(71) Applicant: TYCO FIRE PRODUCTS LP, Lansdale, PA (US)

(72) Inventors: Lyle Miller, Milford, CT (US); Mathew R. Ancone, Warwick, RI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 14/078,377

(22) Filed: Nov. 12, 2013

(65) Prior Publication Data

US 2014/0174765 A1 Jun. 26, 2014

Related U.S. Application Data

(60) Provisional application No. 61/724,843, filed on Nov. 9, 2012.

(51) Int. Cl.

| | |
|---|---|
| ***A62C 37/14*** | (2006.01) |
| ***A62C 31/02*** | (2006.01) |
| ***B05B 1/26*** | (2006.01) |

(52) U.S. Cl.

CPC ..... *A62C 37/14* (2013.01); *A62C 31/02* (2013.01); *B05B 1/265* (2013.01)

(58) Field of Classification Search

CPC ..... A62C 31/02; A62C 37/14; B05B 1/265
USPC ..... 169/37; 239/498, 504, 518, 524
See application file for complete search history.

(56) References Cited

U.S. PATENT DOCUMENTS

| | | | | |
|---|---|---|---|---|
| 5,609,211 | A | 3/1997 | Meyer et al. | |
| 5,865,256 | A * | 2/1999 | Pounder | 169/37 |
| 2001/0042795 | A1 | 11/2001 | Franson et al. | |
| 2007/0114047 | A1 * | 5/2007 | Fischer | 169/37 |
| 2008/0011491 | A1 * | 1/2008 | Thau et al. | 169/37 |
| 2009/0078432 | A1 * | 3/2009 | Tow et al. | 169/37 |
| 2010/0263883 | A1 * | 10/2010 | Abels et al. | 169/37 |
| 2010/0276164 | A1 * | 11/2010 | Feenstra | 169/37 |
| 2011/0036598 | A1 | 2/2011 | Pahila | |
| 2015/0246253 | A1 | 9/2015 | Miller et al. | |

FOREIGN PATENT DOCUMENTS

WO 2014/047499 A2 3/2014

OTHER PUBLICATIONS

International Search Report and Written Opinion, International Application No. PCT/US2013/061017 (published as WO 2014./047499) dated Aug. 5, 2014.

FM Global Company, FM Approvals, Approval Standard for Suppression Mode [Early Suppression Fast Response (ESFR)]..Sprinklers; Class No. 2008, Oct. 2006; 88 pp.

National Fire Protection Association, NFPA 13, Standard for the Installation of Sprinkler Systems, Chapters 3, 12 and Sec. 6.2-6.5 of Chapter 6, 2010 Edition, 22 pages.

Underwriters Laboratories Inc., UL 1767, Early Suppression Fast Response, Sep. 2, 2010, 5 pp.

* cited by examiner

*Primary Examiner* — Len Tran
*Assistant Examiner* — Cody Lieuwen
(74) *Attorney, Agent, or Firm* — Perkins Coie LLP

(57) ABSTRACT

A sprinkler assembly including a fluid deflecting structure including a plurality of spaced apart tines defining a plurality of slots. The tines include a first pair of symmetric tines and a second pair of symmetric tines disposed orthogonally to the first pair of symmetric tines. The tines includes outer edges of varying configuration to define tine and slot geometries and patterns.

19 Claims, 7 Drawing Sheets

SPRINKLER DEFLECTOR

PRIORITY CLAIM & INCORPORATION BY REFERENCE

This application claims the benefit of priority to U.S. Provisional Patent Application No. 61/724,843 filed Nov. 9, 2012, which is incorporated by reference in its entirety.

BACKGROUND OF THE INVENTION

Automatic sprinkler systems are some of the most widely used devices for fire protection. These systems have sprinklers that are activated once the ambient temperature in an environment, such as a room or building exceeds a predetermined value. Once activated, the sprinklers distribute fire-extinguishing fluid, preferably water, in the room or building. A sprinkler system is considered effective if it extinguishes or prevents growth of a fire. The effectiveness of a sprinkler is dependent upon the sprinkler consistently delivering an expected flow rate of fluid from its outlet for a given pressure at its inlet.

An automatic sprinkler may be configured for addressing a fire in a particular mode such as for example, control mode or suppression mode. One form of suppression mode is Early Suppression Fast Response (ESFR) which is defined under industry accepted standards, such as for example, the National Fire Protection Association (NFPA) standard entitled, "NFPA 13: Standards for the Installation of Sprinkler Systems" (2013 ed.) ("NFPA 13"), Section 3.6.4.2 as a sprinkler having a thermal sensitivity, i.e., response time index ("RTI") of 50 meter$^{1/2}$second$^{1/2}$ ("m$^{1/2}$sec$^{1/2}$") or less and "listed" for its capability to provide fire suppression of specific high-challenge fire challenges. A "listed" sprinkler for fire suppression is a sprinkler that has been tested, verified and published in a list by an industry accepted organization, such as for example, FM Global ("FM") and Underwriters Laboratories ("UL") as a sprinkler being suitable for the specified purpose of fire suppression. Fire suppression is defined by NFPA 13, Section 3.3.12 as "[s]harply reducing the heat release rate of a fire and preventing its regrowth by means of direct and sufficient application of water through the fire plume to the burning fuel surface." UL and/or FM test and verify fire suppression performance of a sprinkler by at least installing and subjecting the sprinkler to their respective water distribution test standards: (i) FM Approval Standard Class No. 2008 (2006), which is attached to U.S. Patent Application No. 61/724,843; and (ii) UL Standard for Early-Suppression Fast-Response Sprinklers UL 1767 (2010), which is attached to U.S. Patent Application No. 61/724,843.

The ESFR test standards and requirements for suppression are generally related to the K-factor of the sprinkler. The discharge coefficient or K-factor of a sprinkler allows for an approximation of flow rate to be expected from an outlet of a sprinkler based on the square root of the pressure of fluid fed into the inlet of the sprinkler. As used herein, the K-factor is defined as a constant representing the sprinkler discharge coefficient that is quantified by the flow of fluid in gallons per minute (GPM) from the sprinkler outlet divided by the square root of the pressure of the flow of fluid fed into the inlet of the sprinkler passageway in pounds per square inch (PSI). The K-factor is expressed as GPM/(PSI)$^{1/2}$. NFPA 13 provides for a rated or nominal K-factor or rated discharge coefficient of a sprinkler as a mean value over a K-factor range. Chapters 3, 12 and Sec. 6.2-6.5 of Chapter 6 of the 2010 edition of NFPA 13 are attached to U.S. Patent Application No. 61/724,843. For example, for a K-factor greater than 11, NFPA 13 provides the following nominal K-factors (with the K-factor range shown in parenthesis): (i) 14.0 (13.5-14.5) GPM/(PSI)$^{1/2}$; (ii) 16.8 (16.0-17.6) GPM/(PSI)$^{1/2}$; (iii) 19.6 (18.6-20.6) GPM/(PSI)$^{1/2}$; (iv) 22.4 (21.3-23.5) GPM/(PSI)$^{1/2}$; (v) 25.2 (23.9-26.5) GPM/(PSI)$^{1/2}$; and (vi) 28.0 (26.6-29.4) GPM/(PSI)$^{1/2}$. For purposes herein, suppression performance can be determined for sprinklers having K-factors not listed in the test standards by an appropriate equivalent requirement extrapolated from the available test standards. Moreover, suppression performance may be determined by other criteria in addition to or alternatively to the ESFR test standards, such as for example, by the hydraulic design criteria of the sprinkler and more specifically the hose stream demand criteria.

While ESFR sprinklers are defined by the RTI of the sprinkler and its performance under the test standards, it should be understood that "suppression" mode sprinklers are not necessarily limited to ESFR sprinklers or sprinklers having an RTI of 50 or less. Accordingly, suppression mode sprinklers satisfying standardized test and/or other suppression criteria may have a thermally sensitive trigger having an RTI of fast or standard response sprinklers, i.e., RTI of 50 or greater.

SUMMARY OF THE INVENTION

The present invention is directed to a preferred sprinkler assembly including a preferred fluid deflecting structure. In one particular embodiment, a preferred sprinkler includes a sprinkler frame having a body including an inlet, an outlet and an internal passageway extending between the inlet and the outlet to define a longitudinal sprinkler axis. The outlet and internal passageway of the body preferably define a nominal K-factor of 25.2 GPM/(PSI)$^{1/2}$. The frame preferably includes two frame arms extending distally from the body about the outlet to define a plane bisecting the body such that the arms are equidistantly disposed about the plane. A planar fluid deflecting structure is preferably supported by the frame arms having its center centrally aligned along the longitudinal sprinkler axis with a peripheral edge disposed about the center. In one preferred embodiment, the deflecting structure includes a plurality of spaced apart tines including a first pair of symmetrical tines defining a first axis of symmetry disposed in the plane, each of the first pair of symmetrical tines having an outer edge that defines a first radius of curvature and a second radius of curvature so as to define an inflection point therebetween. A second pair of symmetrical tines define a second axis of symmetry disposed orthogonally with respect to the first axis of symmetry. Preferably, the tines in each of the first and second pairs of symmetrical tines include a first portion defining a constant width and a second portion defining a variable width. In one preferred aspect, the outer edge of the second portion in the second pair of symmetrical tines includes a first segment defining a first included angle with respect to the second axis of symmetry and a second segment defining a second included angle preferably different than the first included angle with respect to the second axis of symmetry.

The deflecting structure further preferably includes an asymmetric slot defined by a pair of spaced apart sidewalls extending from a closed end to an open end, wherein each sidewall includes a first segment defining a first angle with respect to the first and second axes of symmetry and at least a second segment defining a second angle different than the first angle with respect to the first and second axes of symmetry such that the asymmetric slot broadens in a direction from the closed end to the open end, the pair of sidewalls including a first sidewall and a second sidewall, the first sidewall defines a first substantially constant included angle with respect to the first axis of symmetry over a first portion of the length of the asymmetric slot and a substantially constant included second angle different from the first substantially constant included angle over a second portion of the length of the asymmetric slot. The first included angle of the first sidewall preferably ranges between about forty to about forty-five degrees (40°-45°) with respect to the first axis of symmetry, and the second included angle is about 20° with respect to the first axis of symmetry. The second sidewall preferably includes a first segment that extends substantially parallel to the first segment of the first sidewall and a second segment that defines a third included angle with respect to the second axis of symmetry of about thirty degrees.

The deflecting structure preferably includes a first surface and a opposite second surface to define a uniform thickness over the structure with each of the first and second surfaces being perpendicular to the longitudinal sprinkler axis. In one preferred aspect of the deflecting structure, the peripheral edge includes a first peripheral edge defining a first diameter of the deflecting structure about the center, and a second peripheral edge defining a second diameter of the deflecting structure about the center, the second diameter being greater than the first diameter. Moreover, the first sidewall of the asymmetric slot preferably terminates radially at the first peripheral edge and the second sidewall terminates radially at the second peripheral edge. In one preferred embodiment, the first diameter is about 1⅓ inches and the second diameter is about 1.5 inches.

In another preferred embodiment of the deflecting structure, the deflecting structure has a plurality of tines including a first pair of symmetrical tines defining a first axis of symmetry disposed in the plane and a second pair of symmetrical tines defining a second axis of symmetry disposed orthogonally with respect to the first axis of symmetry. Each of the tines in the first and second symmetrical pairs of tines preferably includes a first portion and a second portion spaced outward from the first portion and having a variable width such that the second portion broadens in the direction from the center to one of the first and second peripheral edge. The second portion in each of the first and second pairs of symmetrical tines includes an outer edge having a first segment defining a first angle with respect to the first and second axes of symmetry and a second segment defining a second angle with respect to the first and second axes of symmetry that is preferably different than the first angle. An asymmetric slot is preferably angularly disposed between the first and second symmetrical tines.

In one alternate aspect of the preferred deflector, wherein the tines in at least one of the first pair of symmetrical tines and second pair of symmetrical tines are configured differently. In yet another preferred aspect, the outer edge of the second portion in each of the first symmetric tines has a first segment and a second segment contiguous with the first segment, the first segment defines a first included angle with respect to the first axis of symmetry and the second segment defining a second included angle with respect to the first axis of symmetry that is preferably different than the first included angle. Moreover, the outer edge of the second portion in each of the second symmetric tines has a first segment and a second segment contiguous with the first segment, the first segment in each of the second symmetric tines defining a first included angle with respect to the second axis of symmetry and the second segment in each of the second symmetric tines defines a second included angle with respect to the second axis of symmetry that is preferably different than the first included angle defined by each of the second symmetric tines.

Preferred embodiments of the preferred deflecting structure and sprinkler include one or more features of the deflecting structures and sprinkler assemblies described herein. Accordingly, the preferred deflecting structures have tines or portion thereof that include one or more features of tine width, length or outer edges configuration described herein to define of any one of more of a slot configuration, tine geometry, tine pattern, tine symmetry, tine asymmetry or angular relation to the axes of symmetry previously described to provide for the preferred deflector arrangement. In one preferred embodiment of a sprinkler, a frame includes a body having an inlet, an outlet and an internal passageway extending between the inlet and the outlet to define a longitudinal sprinkler axis. The frame includes two frame arms extending distally from the body about the outlet to define a plane bisecting the body such that the arms are equidistantly disposed about the plane. A preferably planar fluid deflecting structure is supported by the frame arms and includes a center aligned along the longitudinal sprinkler axis and a peripheral edge about the center. The deflecting structure has a plurality of tines preferably including a first symmetrical tine defining a first axis of symmetry disposed in the plane; a second symmetrical tine defining a second axis of symmetry disposed orthogonally with respect to the first axis of symmetry, each of the first and second symmetrical tines includes a first portion having a constant width and a second portion having a variable width such that the second portion broadens in the direction from the center to one of the first and second peripheral edge. The second portion of each of the first and second symmetrical tines includes an outer edge has a first segment defining a first configuration with respect to the first and second axes of symmetry and a second segment defining a second configuration with respect to the first and second axes of symmetry that is different than the first configuration. An asymmetric slot is preferably angularly disposed between the first and second symmetrical tines. The asymmetric slot includes an open end, a closed end defining the radially innermost portion of the slot, and a pair of spaced apart sidewalls extending from the closed end to the open end. Each sidewall includes a first segment defining a first angle with respect to the first and second axes of symmetry and at least a second segment defining a second angle that is preferably different than the first angle with respect to the first and second axes of symmetry such that the asymmetric slot preferably broadens in a direction from the closed end to the open end.

In another preferred embodiment of the sprinkler, the deflecting structure includes a plurality of tines having a first pair of symmetrical tines defining a first axis of symmetry disposed in the plane; a second pair of symmetrical tines defining a second axis of symmetry disposed orthogonally with respect to the first axis of symmetry, each of the first and second pairs of symmetrical tines includes a first portion having a constant width and a second portion having a variable width. The second portion of each of the first and second symmetrical pairs of tines includes an outer edge having a first segment defining a first configuration with respect to the first and second axes of symmetry and a second segment defining a second configuration with respect to the first and second axes of symmetry that is preferably different than the first configuration. Two pairs of asymmetric tines are preferably angularly disposed between the first and second pairs of symmetric tines, the two pairs of asymmetric tines being radially adjacent to one another to define an asymmetric slot therebetween, the asymmetric slot having a first portion with a constant width and a second portion with a variable width radially outward of the first portion of the slot.

In yet another preferred embodiment of sprinkler, the deflecting structure includes the deflecting structure including a plurality of spaced apart tines defining a plurality slots including a first pair of symmetrical tines defining a first axis of symmetry disposed in the plane, each of the first pair of symmetrical tines having an outer edge that defines a first radius of curvature and a second radius of curvature so as to define an inflection point therebetween and a second pair of symmetrical tines defining a second axis of symmetry disposed orthogonally with respect to the first axis of symmetry. Three groups of asymmetric slots radially disposed between the first and second pairs of symmetrical tines, the three groups of asymmetric slots including a first group of asymmetric slots having a first portion with a constant width and a second portion with a variable width radially outward of the first portion of the slot, the first group being radially disposed between a second and third group of asymmetric slots, each of the second and third group of slots having a first portion with a constant width and a second portion with a variable width radially inward of the first portion of the slot.

BRIEF DESCRIPTIONS OF THE DRAWINGS

The accompanying drawings, which are incorporated herein and constitute part of this specification, illustrate exemplary embodiments of the invention, and, together with the general description given above and the detailed description and attachments given below, serve to explain the features of the invention.

DETAILED DESCRIPTION OF THE PREFERRED EMBODIMENTS

Figure 1:
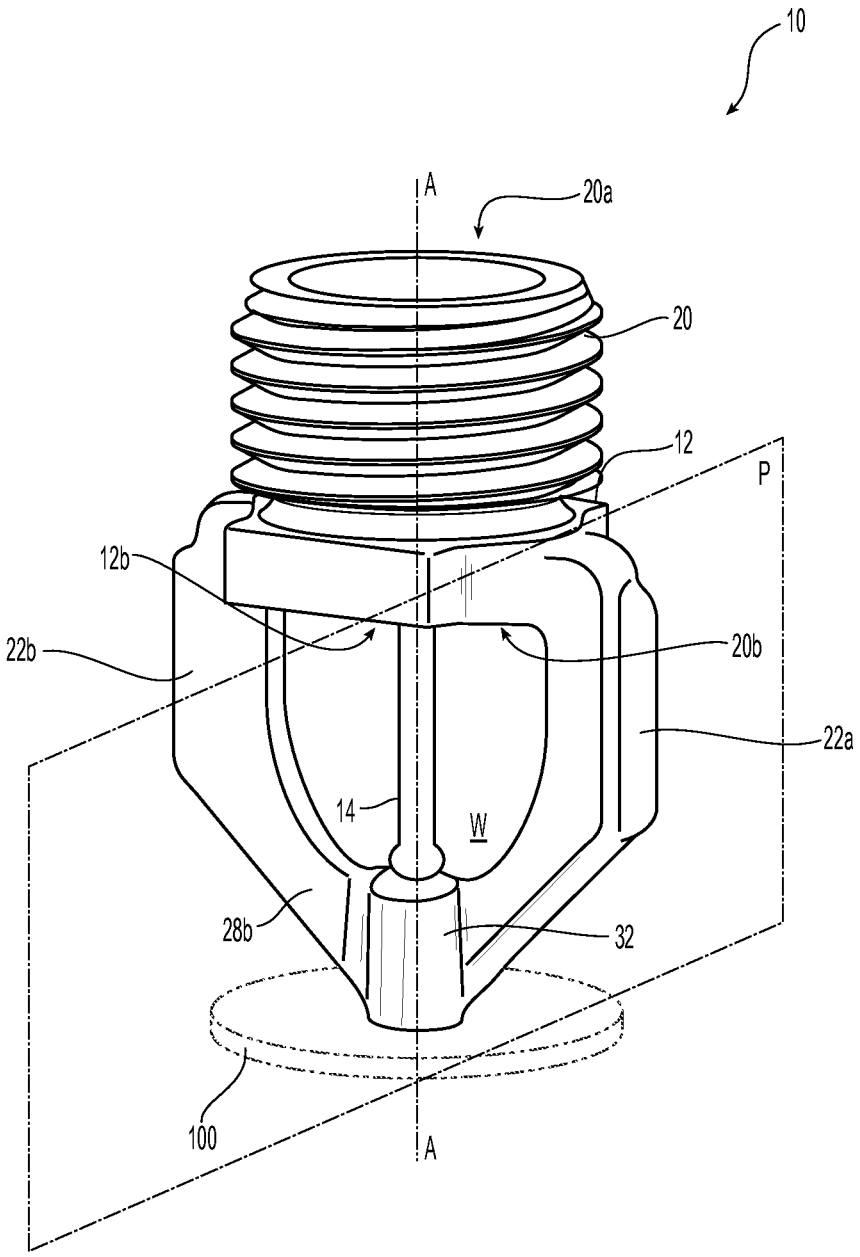
FIG. 1 is an isometric view of preferred embodiment of sprinkler assembly.

FIG. 1 illustrates a preferred embodiment of a sprinkler assembly 10 for installation in a fire protection piping network. The sprinkler assembly 10 includes a sprinkler frame 12, a fluid deflecting structure 100, and a thermal trigger 14 supporting a seal assembly (not shown) to seal the sprinkler in an unactuated configuration. The sprinkler frame 12 includes a body 20 having a proximal inlet 20*a*, a distal outlet 20*b*, and an internal passageway extending therebetween which defines a sprinkler axis A-A. As shown, the thermal trigger 14, is preferably a glass-bulb type trigger disposed and axially aligned along the sprinkler axis A-A for direct loading upon installation of the sprinkler in a fire protection system. Alternative trigger assemblies are possible, such as for example, an off-axis or a strut and lever thermally sensitive solder arrangement.

The sprinkler frame 12 includes one and more preferably two frame arms 22*a*, 22*b* that are radially positioned or diametrically opposed about the body 20 and its outlet 20*b*. The frame arms 22*a*, 22*b* preferably extends axially and distally toward the deflector 100 and preferably converge toward the sprinkler axis A-A to terminate at a terminal end of the frame 12 axially aligned along the sprinkler axis A-A and spaced from the sprinkler distal outlet 20*b*. The fluid deflecting structure 100 is preferably coupled to the distal terminal end of the frame 12 so as to depend or be supported from the frame arms 22*a*, 22*b* at a spaced distance from the distal outlet 20*b*. Fire fighting fluid, such as for example water discharged from the distal outlet 20*b*, impacts the deflecting structure 100 for distribution of the fluid in a desired spray pattern, for example, to satisfy one or more industry accepted performance standards as discussed in greater detail below. A preferred embodiment of the sprinkler assembly 10 provides for a pendent sprinkler configuration, and preferred embodiment of frame 12 is shown and described in U.S. Application No. 61/724,843 and in International PCT Application No. PCT/US2013/060997, filed Sep. 20, 2013, which is incorporated by reference in its entirety. Alternatively, the frame 12 can be configured as the sprinkler frame shown and described in U.S. Pat. No. 7,730,959. As described, the frame arms 22*a*, 22*b* of the sprinkler frame 12 preferably includes surface profiles which define a cross-sectional profile of the frame arm to facilitate the flow of heat toward the sprinkler axis A-A and the preferably axially disposed thermal trigger 14. One or more surfaces of the sprinkler frame arms can further define cross-sectional profiles of the frame arms and fluid deflecting surfaces which redirect fluid discharged from the distal outlet toward the fluid deflecting structure 100. For example, the converging portions of the sprinkler frame arms 22*a*, 22*b* may define a "tear drop" or airfoil cross-sectional profile with a taper in a direction toward the sprinkler axis A-A.

Figure 2:
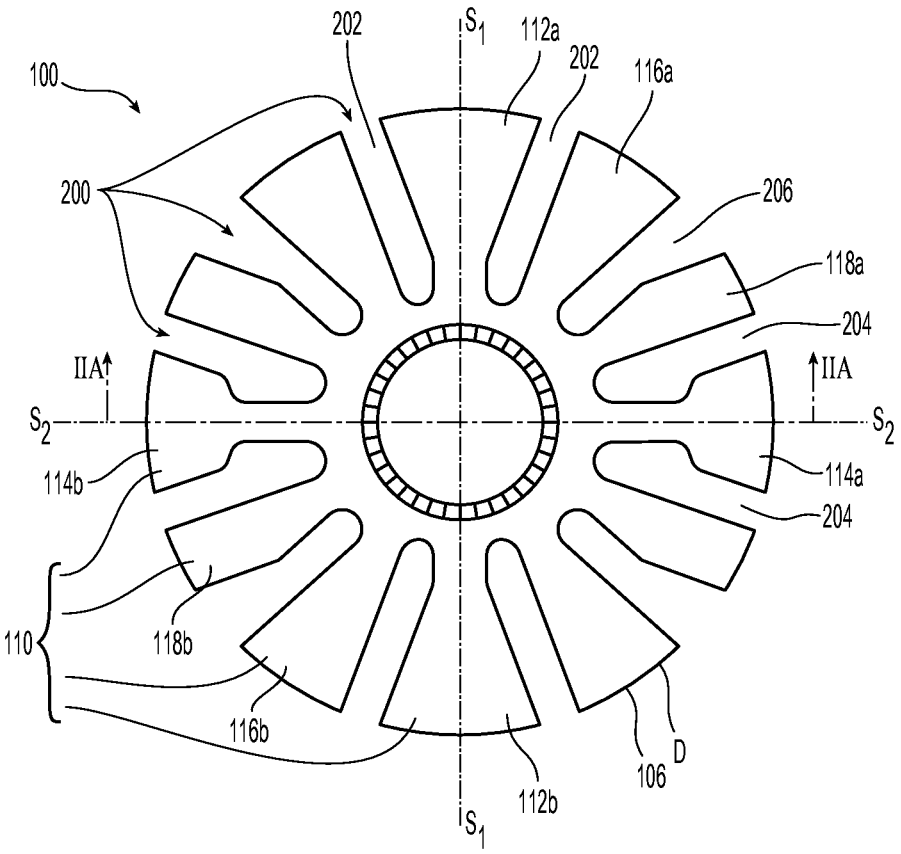
FIG. 2 is a plan view of a preferred deflector member for use in the assembly of FIG. 1.
Figure 2A:
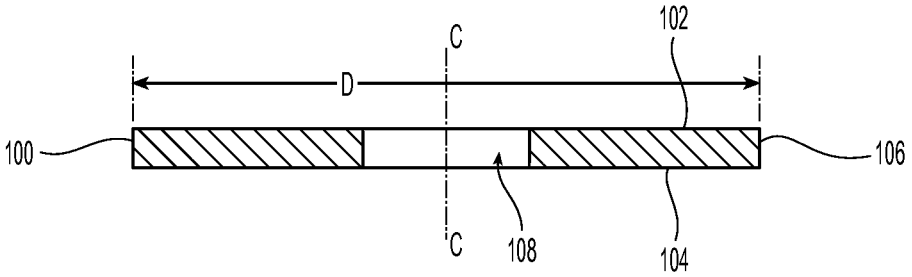
FIG. 2A is a cross-sectional view of the deflector member of FIG. 2 along line IIA-IIA.

Shown in FIGS. 2 and 2A is a preferred fluid deflecting structure 100. The fluid deflecting structure 100 includes a planar surface member 100 and more preferably a planar surface circular planar member 100 having a diameter D. In one preferred embodiment, the diameter D measures about 1¼ inch and is more preferably 1.27 inch. As used herein, the term "about" is understood as within a range of normal tolerance in the art, for example within 2 standard deviations of the mean. "About" can be understood as within 15%, 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term "about". The deflector member 100 has a first surface 102 and an opposite second surface 104 defining a thickness of the member 100 between the first and second surfaces 102, 104 with each of the first and second surface 102, 104 being preferably perpendicular to the sprinkler axis A-A. The thickness of the member 100 is preferably uniform over the member 100. As installed, the first surface 102 defines an upper surface of the deflector member 100 opposed to the outlet 20*b* of the frame 12. The deflector member 100 includes an outer peripheral edge 106 and a preferably circular mounting hole or closed form opening 108 for receiving and engaging the terminal end of the frame 12. The circular opening 108 defines a center C of the deflector 100 for central axial alignment along the sprinkler axis A-A.

Referring to FIG. 2, the deflector member 100 includes a plurality of spaced apart tines 110 which define or alternatively are defined by a plurality of slots 200 therebetween. The plurality of tines include a first pair of symmetrical tines 112*a*, 112*b* preferably diametrically opposed about the circular opening 108 and at least a second pair of symmetrical tines 114*a*, 114*b* preferably diametrically opposed about the circular opening 108. More particularly, the first pair of symmetrical tines 112*a*, 112*b* define a first axis of symmetry S1-S1 and the second pair of symmetrical tines 114*a*, 114*b* define a second axis of symmetry S2-S2 which extends perpendicularly or orthogonally with respect to the first axis of symmetry S1-S1. Disposed radially between the first and second symmetric tines 112, 114 are at least one and more preferably two asymmetric pairs of tines. As shown in FIG. 2, radially disposed between the first symmetric tine pairs 112*a*, 112*b* and the second symmetric tine pairs 114*a*, 114*b* are a first asymmetric tine pair 116*a*, 116*b* and a second asymmetric tine pair 118*a*, 118*b*. The diametrically opposed symmetrical pairs of tines are preferably similarly configured, but may alternatively be differently configured. For diametrically opposed asymmetrical pairs of tines, the tines are also preferably similarly configured, but may be differently configured.

Figure 2B:
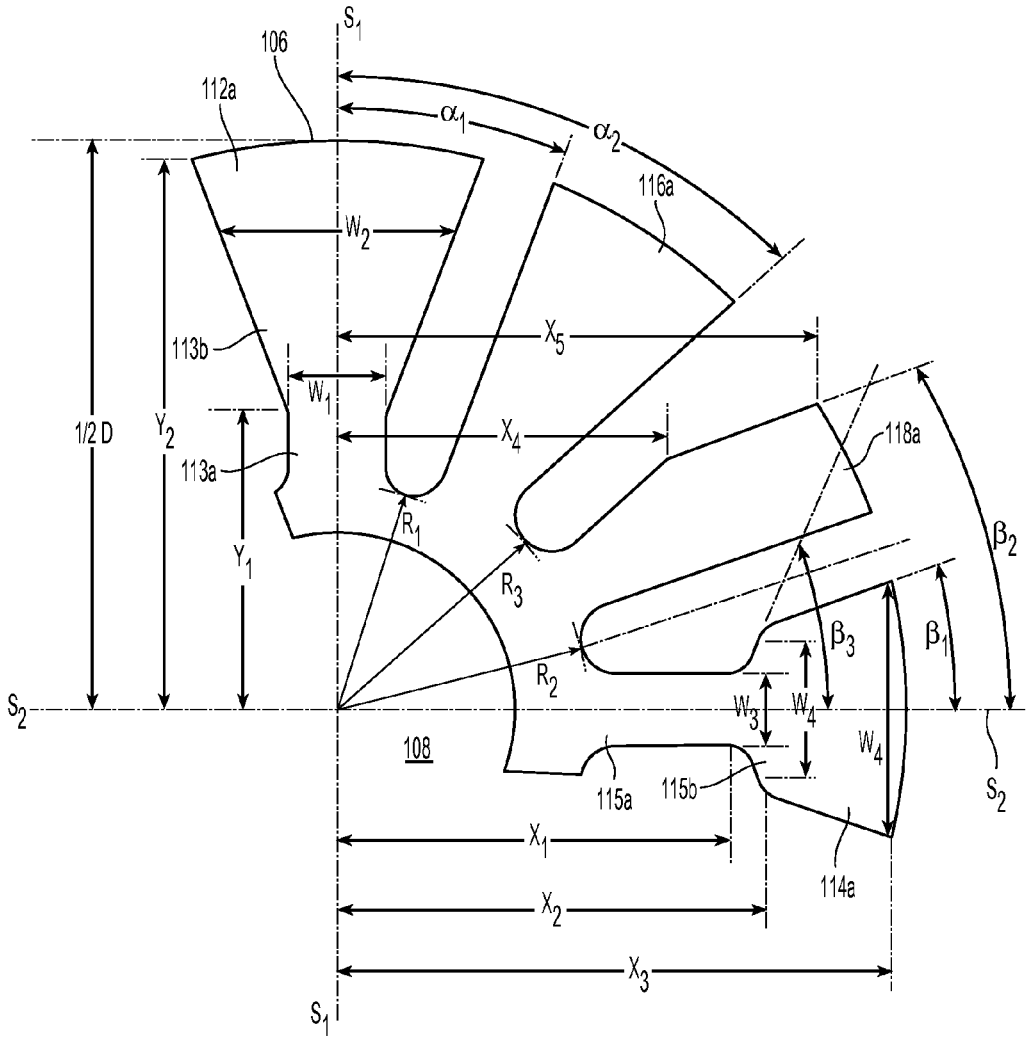
FIG. 2B is a detailed view of the deflector member of FIG. 2.

Each tine of the symmetrical pairs of tines preferably extends in the outward radial direction to define a radial tine length in the direction of the axis of symmetry and a tine width in a direction normal to the axis of symmetry. The tine width can be substantially constant over the tine length, or alternatively, the tine width can be variable over the tine length. More preferably, the tine includes a combination of portions of constant width and variable width along the tine length. For example, the symmetric tines 112, 114 can include a first portion of a constant width, and a second portion of a variable width. The tine width can vary at a constant rate or at a variable rate with respect to the axis of symmetry. Accordingly, the tines 112, 114 can include multiple portions having varying configurations. For example with reference to FIG. 2B, shown is first symmetrical tine 112*a* having a first radial inward portion 113*a* having a preferably constant width W1 and a second portion 113*b* disposed radially outward of the first portion 113*a* and more preferably between the peripheral edge 106 and the first portion 113*a* having a variable width W2. For the preferred 1.27 inch diameter deflector, the first portion 113*a* of the first symmetric tine 112*a* preferably extends from a first end located at a first distance y1, as measured from the second axis of symmetry S2-S2, to a second end located radially inward between the first end of the first portion 113*a* and the central opening 108. The constant first width W1 is preferably about 0.1 inch and the first distance y1 is about ⅓ inch and preferably about 0.325 inch.

The second width W2 of the portion 113*b* preferably broadens in the radial outward direction from the first portion 113*a* such that the second width w2 varies at a preferably constant rate so that the outer edges of the second portion 113*b* of the symmetrical tine 112*a* define a sidewall of a slot having a constant slope or included angle with respect to the axis of symmetry S1-S1, as described in greater detail below. At the peripheral edge 106, the outer edges of the second portion 113*b* preferably defines a distance y2 to the second axis of symmetry S2-S2 of about 0.6 inch and is more preferably about 0.614 inch. At its maximum, the second width W2 defines a width of about 0.32 inch to define a chord length of the tine 112*a*.

Second symmetrical tine 114*a* also preferably includes a first radially inward portion 115*a* having a preferably constant width W3 and a second portion 115*b* between the peripheral edge 106 and the first portion 115*a* having a variable width W4. The first portion 115*a* of the second symmetric tine 114*a* preferably extends from a first end located at a first distance X1, as measured from the first axis of symmetry S1-S1 to a second end radially inward and located between the first end of the first portion 115*a* and the central opening 108. For the preferred deflector member 100, the constant first width W3 is about 0.1 inch and preferably about 0.08 inch; and the first distance x1 is about 0.5 inch and preferably about 0.434 inch.

The second width W4 of the second portion 115*b* preferably broadens in the radially outward direction from the first portion 115*a* such that the second width W4 varies at a first preferably constant rate and then more preferably varies at a second preferably different constant rate to define a third variable width W4' so that the outer edges of the second portion 115*b* of the symmetrical tine 114*a* define a sidewall of a slot having first and second constant slopes or included angles with respect to the axis of symmetry S1-S1, as described in greater detail below. The outer edges of the preferred second portion 115*b* define a junction at the transition from the first rate of change in width to the second rate of change. The junction further defines a preferred distance x2 to the first axis of symmetry S1-S1 of about 0.5 inch. At the junction, the second width W4 defines a preferred width of about 0.14 inch. At the peripheral edge 106, the outer edges of the second portion 115*b* preferably define a distance X3 to the first axis of symmetry S1-S1 of about 0.6 inch and is more preferably about 0.62 inch. At its maximum, the third width W4' defines a width of about ⅓ inch and more preferably 0.28 inch to define a chord length of the tine 114*a*.

As noted above, the plurality of spaced apart tines 110 of the deflector 100 are defined by or alternatively define the slots 200 formed therebetween. Preferably radially disposed about the deflector center C-C, between orthogonally oriented first and second symmetric tines 112, 114, are at least three groups of asymmetric slots. Moreover, each of the asymmetric slots has a first portion with a constant width and a second portion having a variable width. The slot widths are measured normal to at least one sidewall defining the slot. In one preferred arrangement, an asymmetric slot having a first portion of a constant width radially inward of a second portion with a variable width is radially or angularly disposed between two slots having the constant width portion radially outward relative to its inner portion of a variable width.

Figure 2C:
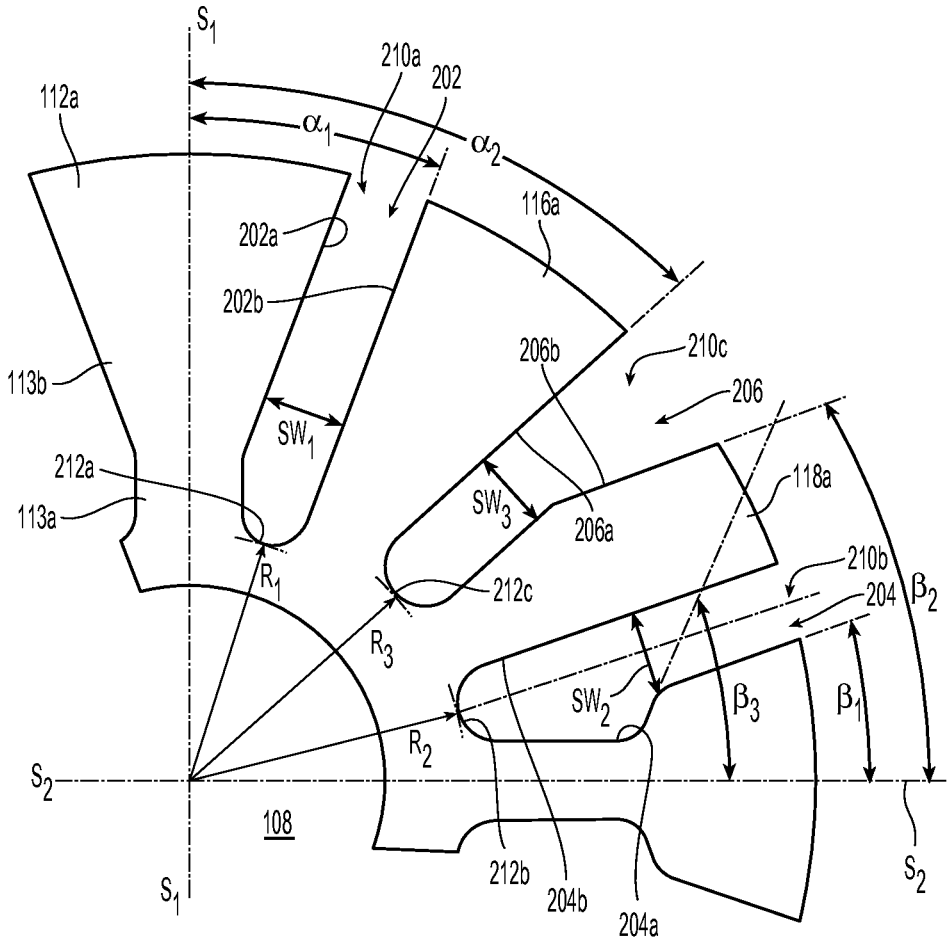
FIG. 2C is another detailed view of the deflector member of FIG. 2.

The preferred deflector member 100 includes three types of asymmetrical slot groups 202, 204, 206 radially disposed between the perpendicularly disposed symmetrical tines 112, 114. As shown in FIG. 2C, the slots 200 include open ended slots having a first open end 210 at the peripheral edge 106 and a second closed end 212 between the peripheral edge 106 and the central opening 108 of the deflector. It should be understood that the deflector may include one or more closed form slots provided the resulting deflector can provide the desired water distribution pattern, for example, as described herein. Each of the closed ends of each slot preferably is defined by a radiused portion having one point which defines the radially innermost portion of the slot. More specifically, the radiused portion of the closed end preferably defines a tangent to a circle having its center aligned with the deflector center C to further define the radial distance R to the radially innermost portion of the slot 200. Extending between the open and closed ends 210, 212 are spaced apart sidewalls defined by the outer edge of radially adjacent tines. Depending on the profile of each radially adjacent tine and its outer edges, the sidewalls may converge, diverge or extend parallel with respect to one another to define the asymmetric slot 200 therebetween.

Referring to FIG. 2 of the preferred deflector 100, contiguously formed about the first symmetrical tines 112*a*, 112*b* is the first group of asymmetric slots 202; and contiguously formed about the second symmetrical tines 114*a*, 114*b* is the second group of asymmetric slots 204. Disposed between the first and second asymmetric slots 202, 204 are the third group of asymmetric slots 206. As shown in the detailed view of FIG. 2C, the first asymmetric slot 202 includes a slot open end 210*a* at the peripheral edge 106 of the deflector and a closed end 212*a* disposed radially inward of the open end 210*a*. The closed end 212*a* defines the radially innermost portion of the slot 202 disposed at a preferred radial distance R1 from the center C of the deflector 100 of about 0.25 inch. Extending between the open and closed ends 210*a*, 212*a* are the first sidewall 202*a* and second sidewall 202*b* of the asymmetric slot 202, which respectively correspond to the outer edges of symmetrical and asymmetrical tines 112*a*, 116*a*. The first and second sidewalls 202*a*, 202*b* are spaced apart and define one or more angles with respect to the axes of symmetry S1-S1, S2-S2 to define the profile of the asymmetric slot 202 and the slot width SW1 over the length of the slot. In the preferred embodiment of the asymmetric slot 202, the second sidewall 202*b* defines a substantially constant angle $\alpha 1$ with respect to the first axis of symmetry S1-S1 over the length of the slot 202. The angle $\alpha 1$ more preferably defines an angle of about twenty degrees and even more preferably about 21°. The first sidewall 202*a* preferably includes a first segment that extends substantially parallel to the second sidewall 202*b* and a second segment that extends substantially parallel to the first axis of symmetry S1-S1. The first segment preferably extends inwardly from the slot open end 210*a* preferably to the first end of the first portion 113*a* of the symmetric tine 112*a*. Accordingly for the preferred slot 202, the slot width SW1 is substantially constant for the first portion of the slot 202 defining a preferred width of about 0.8 inch. The constant width portion of the slot 202 is preferably radially outward with respect to the second portion of the slot in which the slot width SW1 varies.

As shown in FIG. 2, contiguously formed about the second symmetrical tines 114*a*, 114*b* is the second group of asymmetric slots 204. The second asymmetric slot 204 includes a slot open end 210*b* at the peripheral edge 106 and a closed end 212*b* disposed radially inward of the open end 210*b*. Referring again to FIG. 2C, the closed end 212*b* defines the radially innermost portion of the slot 204 disposed at a preferred radial distance R2 from the center C of the deflector 100 of about 0.3 inch and is more preferably about 0.28 inch. Extending between the open and closed ends 210*b*, 212*b* are the first sidewall 204*a* and second sidewall 204*b* of the asymmetric slot 204, which respectively correspond to the outer edges of symmetrical and asymmetrical tines 114*a*, 118*a*. The first and second walls 204*a*, 204*b* are spaced apart and define one or more angles with respect to the axes of symmetry to define the profile of the asymmetric second slot 204 and the slot width SW2 over the length of the slot. In the preferred embodiment of the asymmetric slot 204, the first sidewall 204*a* preferably includes: (i) a first segment that preferably extends radially outwardly from the closed end 212*b* parallel to the second axis of symmetry S2-S2; (ii) a second segment which preferably extends inwardly from the open end 210*b* to define a first included angle $\beta 1$ with respect to the second axis of symmetry S2-S2; and (iii) at least a third segment preferably between the first and second segment which defines a second included angle $\beta 3$ with respect to the second axis of symmetry different than the first included angle $\beta 1$ and more preferably greater than the first angle $\beta 1$. For the preferred deflecting member 100, the first angle $\beta 1$ of the first sidewall is preferably about twenty degrees and even more preferably about 19°. The second angle $\beta 3$ of the second segment of the first sidewall 204*a* is preferably about seventy degrees with respect to the second axis of symmetry and more preferably about 69°.

The second sidewall 204*b* of the second group of asymmetric slots 204 preferably extends from the open end 210*b* and parallel to the second segment of the first sidewall 204*a* to defines a substantially constant angle with respect to the second axis of symmetry S2-S2 over the length of the slot 204. Accordingly, the second sidewall 204*b* preferably defines an included angle with the second axis of symmetry S2-S2 to be about twenty degrees and even more preferably about 19°. For the preferred second asymmetric slot 204, the slot width SW2 is substantially constant for the first portion of the slot 204 defining a preferred width of about 0.08 inch. The constant width portion of the slot 204 is preferably radially outward with respect to the second portion of the slot having in which the slot width SW2 varies. More particularly for the preferred second asymmetric slot 204, the slot width SW2 is initially substantially constant over the second segment of the first sidewall 204*a* and then varies over the first and third segments of the first sidewall 204*a* radially inward of the second segment of the sidewall 204*a*.

Referring to FIG. 2, disposed between the first and second asymmetric slots 202, 204 is the third group of asymmetric slots 206 and contiguously formed with the asymmetric tines 116*a*, 118*a*. As shown in the detailed view of FIG. 2C, the third asymmetric slot 206 includes a slot open end 210*c* at the peripheral edge 106 and a closed end 212*c* disposed radially inward of the open end 210*c*. The closed end 212*c* defines the radially innermost portion of the slot 206 disposed at a preferred radial distance R3 from the center C of the deflector 100 of about 0.3 inch and is more preferably about 0.28 inch. Extending between the open and closed ends 210*c*, 212*c* are the first sidewall 206*a* and second sidewall 206*b* of the asymmetric slot 206, which respectively correspond to the outer edges of the asymmetrical tines 116*a*, 118*a*. The first and second sidewalls 206*a*, 206*b* are spaced apart and define one or more angles with respect to the axes of symmetry to define the profile of the asymmetric slot 206 and the slot width SW3 over the length of the slot. In the preferred embodiment of the asymmetric slot 206, the first sidewall 206*a* defines a substantially constant included angle $\alpha 2$ with respect to the first axis of symmetry S1-S1 over the length of the slot 206. The angle $\alpha 2$ more preferably defines an angle ranging between about forty-five to about fifty degrees (45°-50°) and even more preferably about 48° with respect to the first axis of symmetry S1-S1. The second sidewall 206*b* preferably includes a first segment that extends substantially parallel to the first sidewall 206*a* and a second segment that defines a third angle $\beta 2$ to the second axis of symmetry S2-S2. The first segment preferably extends outwardly from the slot closed end 212*c* preferably to the second segment of the second sidewall 206*b*. The third angle $\beta 2$ to the second axis of symmetry S2-S2 is preferably constant from the first segment to the peripheral edge 106 and defines a preferred included angle $\beta 2$ of about twenty degrees. Accordingly for the preferred slot 206, the slot width SW3 is substantially constant for the first portion of the slot 206 defining a preferred width of about 0.08 inch. The constant width portion of the slot 206 is preferably radially inward with respect to the second portion of the slot in which the slot width SW3 varies.

More generally and with reference to FIGS. 2 and 2C, the subject deflector 100 provides an arrangement of tines and slots to provide for water distribution satisfying a desired sprinkler application. Moreover, the deflector 100 provides for a quadrant of the deflector having a slot preferably disposed at about the 45 degree angle relative to the quadrant defining axes S1-S1, S2-S2. The subject slot is generally preferably defined by a first sidewall that is straight over the slot length to define a constant angle with respect to each of the deflector axes, S1-S1, S2-S2, and a second sidewall that varies over its length to define two or more angles with respect to the deflector axes and more preferably broaden the slot in the direction from the deflector to center to the peripheral edge.

For the preferred sprinkler assembly 10 shown in FIG. 1, the deflector member 100 may be mounted to the sprinkler frame 12 such that the first axis of symmetry S1-S1 is disposed in a plane P which bisects the frame 12 and more preferably is equidistantly disposed between the frame arms 22*a*, 22*b*. Accordingly, for the preferred sprinkler assembly 10, the first pair of symmetric tines 112*a*, 112*b* extend normal to the sprinkler frame window W defined by the frame arms 22*a*, 22*b*. Thus, for the preferred sprinkler assembly 10, the second axis of symmetry S2-S2 and second group of symmetric tines 114*a*, 114*b* are aligned orthogonally to the plane P and substantially in a direction toward the frame arms 22*a*, 22*b*.

The preferred sprinkler frame 12 further preferably defines a discharge coefficient with a nominal K-factor of about 14.0 GPM/(PSI)$^{1/2}$ and a preferred outlet-to-deflector distance of about 1¼ inch, and more particularly at an outlet-to-deflector distance of 1.27 inches. The combination of the preferred outlet-to-deflector distance and the preferred deflector diameter provides for an overall compact sprinkler assembly. The preferred sprinkler assembly 10 with the preferred deflector 100 has been tested for water distribution in accordance with the industry accepted standard, FM Approval Standard Class No. 2008 (October 2006). More specifically, the preferred sprinkler and deflector was installed and subjected to water distribution testing conforming with the FM sprinkler water distribution tests of Section 4.29 of FM Approval Standard Class No. 2008, entitled "Water Distribution (ESFR K14.0 and K16.8 Pendent Sprinklers Only)". The sprinkler assembly with the preferred deflector 100 has been shown to satisfy each requirement of each of the FM sprinkler water distribution tests of Section 4.29, Table 4.29.1a of FM Approval Standard Class No. 2008. Distribution testing satisfying the water distribution requirements show the preferred deflector 100 can be configured for use in a suppression, and more, specifically an Early Suppression Fast Response (ESFR) sprinkler configuration. Thus, it has been shown that the arrangement of slots and tines and/or their particularized configurations define fluid deflecting surfaces and passageways of the sprinkler to distribute water to satisfy the fluid density requirements, measured in gallons per minute per square foot (GPM/SQ. FT.), under the industry accepted standards. In view of the satisfactory FM testing, it is believed that the arrangement of tines and slots define a deflector configuration that distributes a flow of water from the outlet of the sprinkler frame in a fluid density pattern that satisfies the ESFR fluid distribution requirements under Section 45, UL Standard for Early-Suppression Fast-Response Sprinklers UL 1767 (2010).

Figure 3:
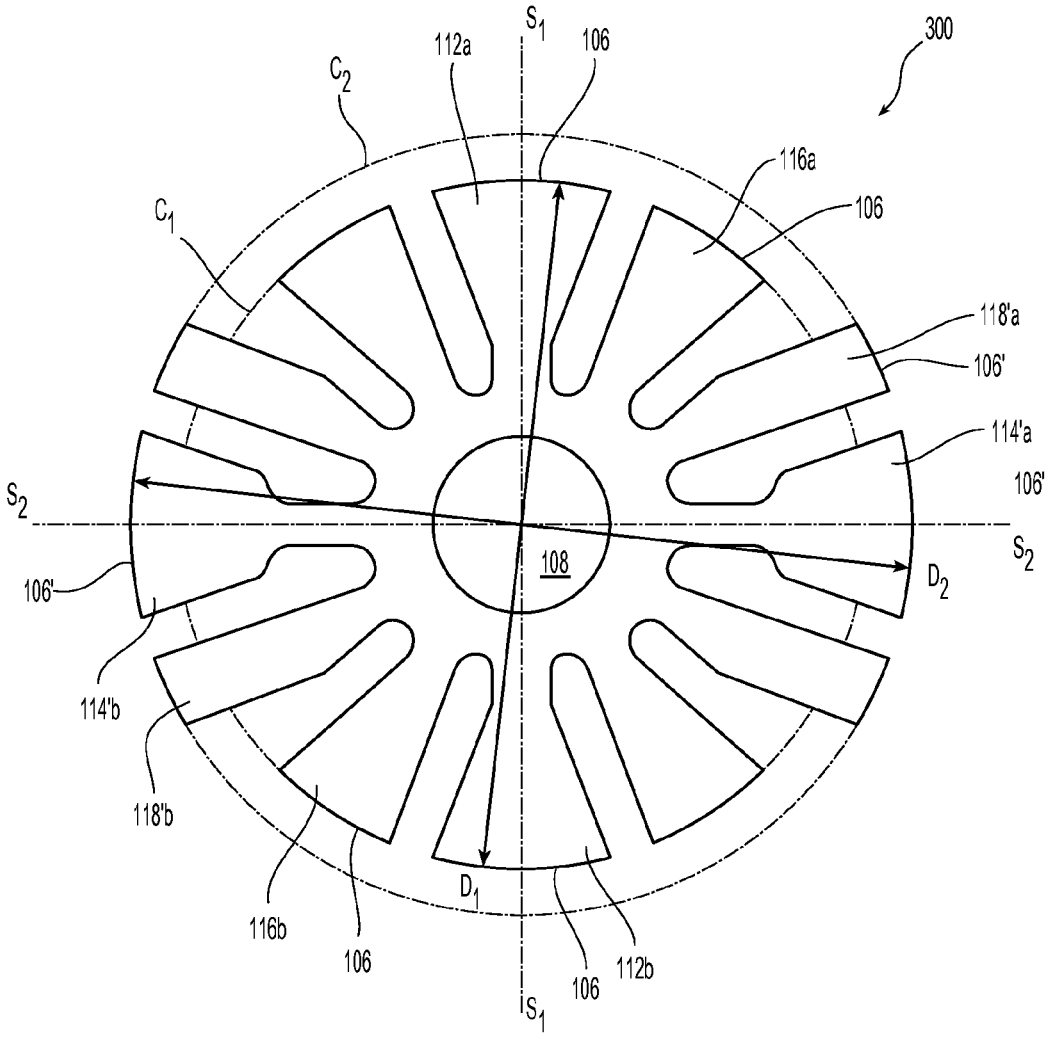
FIG. 3 is a plan view of another preferred deflector member for use in the assembly of FIG. 1.

As noted above, the deflector member 100 of FIG. 2 is substantially circular. In an alternate embodiment, for example as shown in FIG. 3, the deflector member 300 can be substantially non-circular. In one preferably exemplary embodiment of a deflector 300 can define two or more diameters such that the deflector is, for example, oblong. More specifically, the deflector 300 includes a first pair of diametrically opposed symmetrical tines 112*a*, 112*b* having peripheral edges 106 to define a first diameter D1, which preferably measures about 1¼ inch and more preferably 1.27 inch. The deflector member 300 further includes a preferred second pair of diametrically opposed symmetrical tines 114'*a*, 114'*b* having peripheral edges 106' which define a second diameter D2 that is preferably greater than D1. In one particular embodiment, the second diameter D2 is about 1.5 inches and more preferably 1.44 inches. For the deflector 300, the first and second diameters D1, D2 respectively define first concentric circle C1 and second concentric circle C2.

In another preferred aspect, the tines disposed between the first and second symmetric tines 112, 114' of the sprinkler can include peripheral edges disposed on either one of the first and second concentric circles C1, C2. For example, in the preferred deflector 300, the first asymmetric tine pair 116*a*, 116*b* include a peripheral edge 106 disposed on the first concentric circle C1. The preferred deflector 300 further preferably includes a second asymmetric tine pair 118'*a*, 118'*b* having a peripheral edge 106' disposed on the second concentric circle C2. The preferred deflector 300 can include preferred features previously described, for example, the outer edges of the tines and defining the slot sidewalls can define the angular relations previously described.

Figure 4:
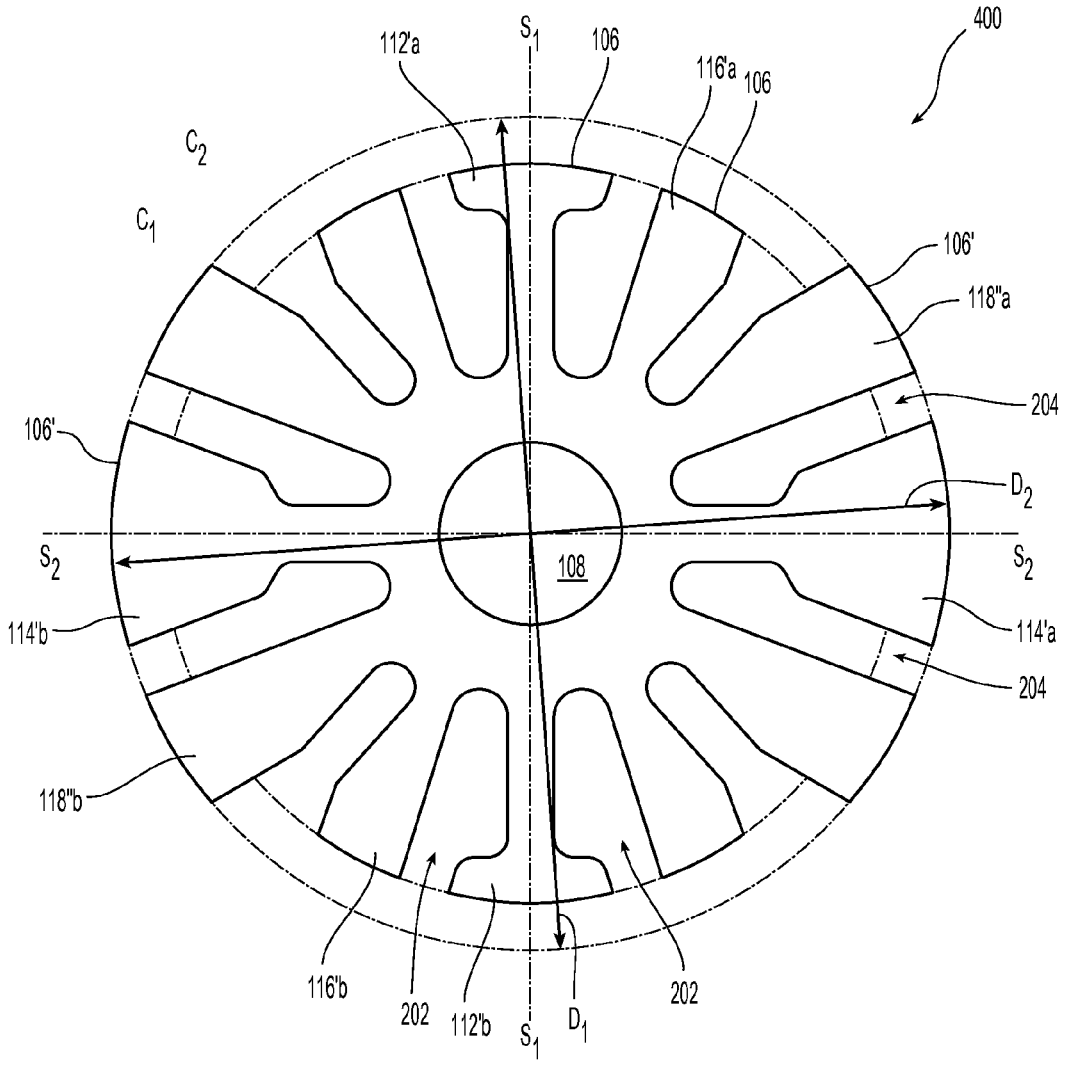
FIG. 4 is a plan view of another preferred deflector member for use in the assembly of FIG. 1.

Shown in FIG. 4 is another substantially non-circular deflector member 400. The deflector 400 includes a first pair of diametrically opposed symmetrical tines 112'*a*, 112'*b* having peripheral edges 106 to define a first diameter D1, which preferably measures about 1⅓ inch and more preferably 1.328 inch. The deflector member 400 further includes a preferred second pair of diametrically opposed symmetrical tines 114'*a*, 114'*b* having peripheral edges 106' which define a second diameter D2 that is preferably greater than D1. In one particular embodiment, the second diameter D2 is about 1.5 inches, preferably 1.48 inches and more preferably or alternatively 1.536 inches. For the deflector 400, the first and second diameters D1, D2 respectively define first concentric circle C1 and second concentric circle C2.

In another preferred aspect, the tines disposed between the first and second symmetric tines 112, 114' of the sprinkler can include peripheral edges disposed on either one of the first and second concentric circles C1, C2. For example, in the preferred deflector 400, the first asymmetric tine pair 116*a*, 116*b* include a peripheral edge 106 disposed on the first concentric circle C1. The preferred deflector 300 further preferably includes a second asymmetric tine pair 118'*a*, 118'*b* having a peripheral edge 106' disposed on the second concentric circle C2.

Figure 4A:
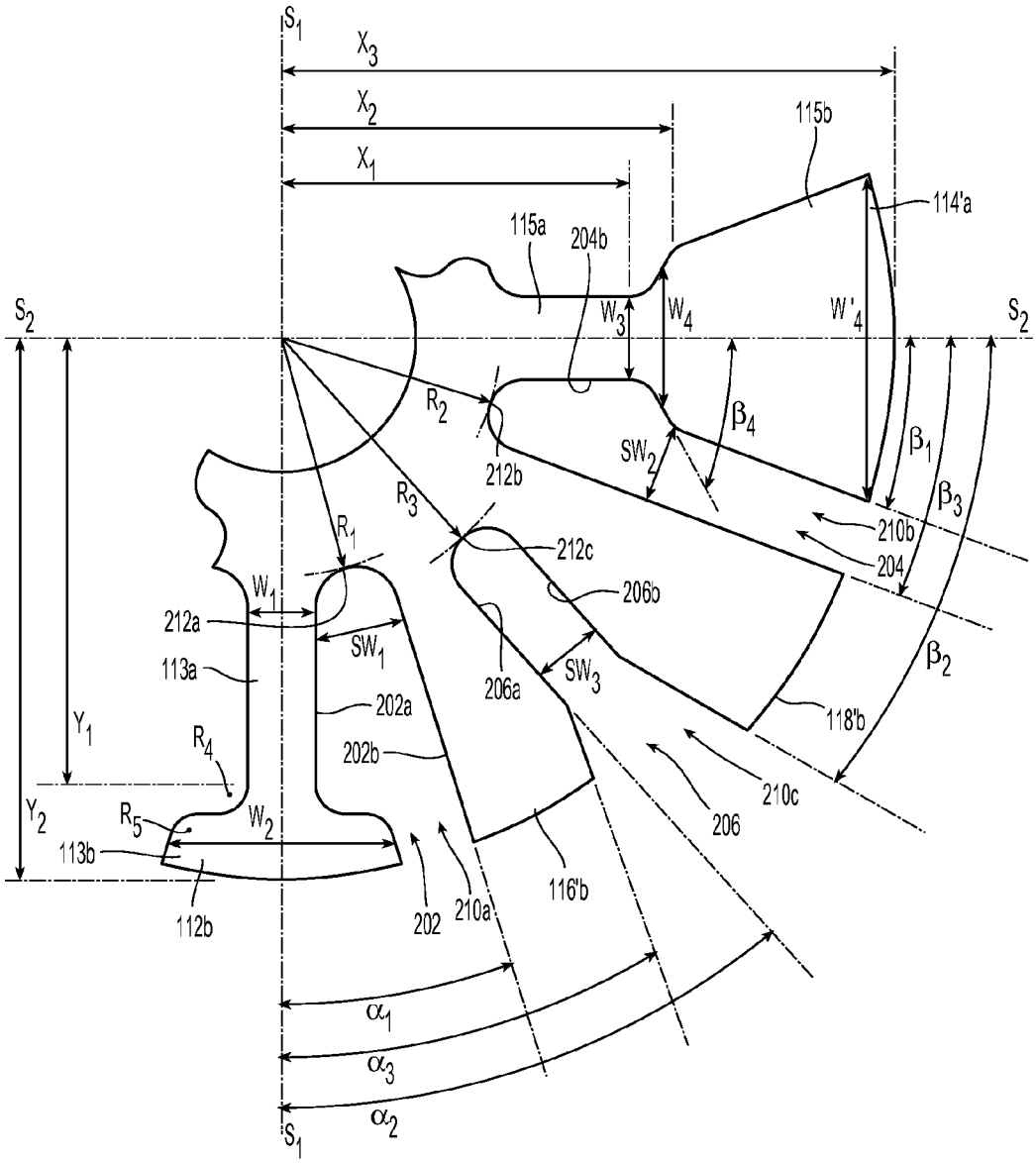
FIG. 4A is a detailed view of the deflector member of FIG. 4.

The preferred deflector 400 can include preferred features previously described, for example, the outer edges of the tines defining the slot sidewalls can define one or more of the tine configurations and/or angular relations previously described. For example with reference to FIG. 4A, shown is first symmetrical tine 112'*b* having a first radial inward portion 113*a* having a preferably constant width W1 and a second portion 113*b* between the peripheral edge 106 and the first portion 113*a* having a variable width W2 and more preferably broadening or widening in the radially outward direction. The first portion 113*a* of the first symmetric tine 112*a* preferably extends from a first end located at a first distance y1, as measured from the second axis of symmetry S2-S2, to a second end located radially inward between the first end of the first portion 113*a* and the central opening 108. The constant first width W1 is preferably about 0.1 inch and the first distance y1 is about ½ inch and preferably about 0.583 inch. At the peripheral edge 106, the outer edges of the second portion 113*b* preferably defines a distance y2 to the second axis of symmetry S2-S2 of about ⅔ inch and is more preferably about 0.680 inch.

The second width W2 of the second portion 113*b* preferably broadens in the radially outward direction from the first portion 113*a*. The second portion 113*b* can include outer edges with a first segment and a second segment each defining distinct or different included angles with the first axis of symmetry so as to provide for the variable rate of change in tine width W2. More preferably, the second width W2 of the portion 113*b* preferably broadens in the radially outward direction from the first portion 113*a* such that the second width w2 varies at a preferably variable rate so that the outer edges of the second portion 113*b* of the symmetrical tine 112'*b* define an inflection point over the radial length of the second portion 113*b*. In one preferred embodiment, the outer edge 202*a* over the second portion 113*b* defines a first radius of curvature R4 such that the outer edge 202*a* of the tine curves away from the first axis of symmetry S1-S1 to broaden the second portion 113*b* of the symmetrical tine 112'*b* relative to the first portion. The outer edge 202*a* further preferably includes a second radius of curvature R5 contiguous with and radially outward of the first radius of curvature R4. The second radius of curvature R5 is such that the outer edge 202*a* of the tine 112 curves toward the first axis of symmetry S1-S1 and the peripheral edge 106. Each of the first and second radii of curvatures R4, R5 define a radius of about 0.4 inch and is more preferably 0.037 inch. The centers of the first and second radii of curvatures R4, R5 are preferably disposed about the outer edge 202*a* to define the preferred flexpoint along the outer edge 202*a* between the first and second radii of curvatures R4, R5.

Second symmetrical tine 114'*a* also preferably includes a first radially inward portion 115*a* having a preferably constant width W3 and a second portion 115*b* between the peripheral edge 106 and the first portion 115*a* having a variable width W4. The first portion 115*a* of the second symmetric tine 114*a* preferably extends from a first end located at a first distance X1, as measured from the first axis of symmetry S1-S1 to a second end radially inward and located between the first end of the first portion 115*a* and the central opening 108. For the preferred deflector member 100, the constant first width W3 is about 0.1 inch and preferably about 0.085 inch; and the first distance x1 is about 0.5 inch and preferably 0.563 inch.

The second width W4 of the second portion 115*b* preferably broadens in the radially outward direction from the first portion 115*a* such that the second width W4 varies at a first preferably constant rate and then more preferably varies at a second preferably different constant rate to define a third variable width W4' so that the outer edges of the second portion 115*b* of the symmetrical tine 114'*a* define a sidewall of a slot having first and second constant slopes or included angles with respect to the axis of symmetry S2-S2, as substantially similarly previously described. The outer edges of the preferred second portion 115*b* define a junction at the transition from the first rate of change in width to the second rate of change. The junction further defines a preferred distance x2 to the first axis of symmetry S1-S1 of about 0.5 inch. At the junction, the second width W4 defines a preferred width of about 0.2 inch. At the peripheral edge 106, the outer edges of the second portion 115*b* preferably define a distance X3 to the first axis of symmetry S1-S1 of about ¾ inch and is more preferably 0.768 inch. At its maximum, the third width W4' defines a width of about ⅖ inch and more preferably 0.4 inch to define a chord length of the tine 114*a*.

As noted above, the plurality of spaced apart tines 110 of the deflector 100 are defined by or alternatively define the slots 200 formed therebetween. Preferably radially or angularly disposed about the deflector center C-C, between orthogonally oriented first and second symmetric tines 112, 114, are at least three groups of asymmetric slots. Moreover, each of the asymmetric slots has a first portion with a constant width and a second portion having a variable width. The slot widths are measured normal to at least one sidewall defining the slot. Like the previously described deflector, the previously described deflector 400 includes an asymmetric slot having a first portion of a constant width radially inward of a second portion with a variable width radially or angularly disposed between two slots having the constant width portion radially outward relative to its inner portion of a variable width.

The preferred deflector member 400 includes three types of asymmetrical slot groups 202, 204, 206 radially or annularly disposed between the perpendicularly disposed symmetrical tines 112, 114. As shown in FIG. 4A, the slots 200 include open ended slots having a first open end 210 at the peripheral edge 106 and a second closed end 212 between the peripheral edge 106 and the central opening 108 of the deflector. Each of closed ends of each slot preferably is defined by a radiused portion having one point which defines the radially innermost portion of the slot. More specifically, the radiused portion of the closed end preferably defines a tangent to a circle having its center aligned with the deflector center C to further define the radial distance R to the radially inner most portion of the slot 200. Extending between the open and closed ends 210, 212 are spaced apart sidewalls defined by the outer edge of radially adjacent tines. Depending on the profile of each radially adjacent tine and its outer edges, the sidewalls may converge, diverge or extend parallel with respect to one another to define the asymmetric slot 200 therebetween.

Referring to FIG. 4 of the preferred deflector 400, contiguously formed about the first symmetrical tines 112'*a*, 112'*b* is the first group of asymmetric slots 202; and contiguously formed about the second symmetrical tines 114'*a*, 114'*b* is the second group of asymmetric slots 204. Disposed between the first and second asymmetric slots 202, 204 are the third group of asymmetric slots 206. As shown in the detailed view of FIG. 4A, the first asymmetric slot 202 includes a slot open end 210*a* at the peripheral edge 106 of the deflector and a closed end 212*a* disposed radially inward of the open end 210*a*. The closed end 212*a* defines the radially innermost portion of the slot 202 disposed at a preferred radial distance R1 from the center C of the deflector 100 of about 0.3 inch. Extending between the open and closed ends 210*a*, 212*a* are the first sidewall 202*a* and second sidewall 202*b* of the asymmetric slot 202, which respectively correspond to the outer edges of symmetrical and asymmetrical tines 112'*b*, 116*a*. The first and second sidewalls 202*a*, 202*b* are spaced apart and define one or more angles with respect to the axes of symmetry S1-S1, S2-S2 to define the profile of the asymmetric slot 202 and the slot width SW1 over the length of the slot. In the preferred embodiment of the asymmetric slot 202, the second sidewall 202*b* defines a substantially constant angle α1 with respect to the first axis of symmetry S1-S1 over the length of the slot 202. The angle α1 more preferably defines an angle of about twenty degrees and even more preferably about 17°. The first sidewall 202*a* preferably includes a first segment that extends substantially parallel to the second sidewall 202*b* and a second segment that extends substantially parallel to the first axis of symmetry S1-S1. The first segment preferably extends inwardly from the slot open end 210*a* preferably to the first end of the first portion 113*a* of the symmetric tine 112'*a*. Accordingly for the preferred slot 202, the slot width SW1 is substantially constant for the first portion of the slot 202 defining a preferred width of about 0.1 inch. The constant width portion of the slot 202 is preferably radially outward with respect to the second portion of the slot in which the slot width SW1 varies.

As shown in FIGS. 4 and 4A, contiguously formed about the second symmetrical tines 114'*a*, 114'*b* is the second group of asymmetric slots 204. The second asymmetric slot 204 includes a slot open end 210*b* at the peripheral edge 106 and a closed end 212*b* disposed radially inward of the open end 210*b*. The closed end 212*b* defines the radially innermost portion of the slot 204 disposed at a preferred radial distance R2 from the center C of the deflector 100 of about 0.25 inch and is more preferably about 0.27 inch. Extending between the open and closed ends 210*b*, 212*b* are the first sidewall 204*a* and second sidewall 204*b* of the asymmetric slot 204, which respectively correspond to the outer edges of symmetrical and asymmetrical tines 114'*a*, 118'*a*. The first and second walls 204*a*, 204*b* are spaced apart and define one or more angles with respect to the axes of symmetry to define the profile of the asymmetric second slot 204 and the slot width SW2 over the length of the slot. In the preferred embodiment of the asymmetric slot 204, the first sidewall 204*a* preferably includes: (i) a first segment that preferably extends radially outwardly from the closed end 212*b* parallel to the second axis of symmetry S2-S2; (ii) a second segment which preferably extends inwardly from the open end 210*b* to define a first included angle β1 with respect to the second axis of symmetry S2-S2; and (iii) at least a third segment preferably between the first and second segment which defines a second included angle β4 with respect to the second axis of symmetry different than the first included angle β1 and more preferably greater than the first angle β1. For the preferred deflecting member 100, the first angle β1 of the first sidewall 204*a* is preferably about twenty degrees and even more preferably about 21°. The second angle β4 of the second segment of the first sidewall 204*a* is preferably about sixty degrees with respect to the second axis of symmetry and more preferably about 60°.

The second sidewall 204*b* of the second group of asymmetric slots 204 preferably extends from the open end 210*b* and parallel to the second segment of the first sidewall 204*a* to defines a substantially constant angle with respect to the second axis of symmetry S2-S2 over the length of the slot 204. Accordingly, the second sidewall 204*b* preferably defines an included angle with the second axis of symmetry S2-S2 to be about twenty degrees and even more preferably about 21°. For the preferred second asymmetric slot 204, the slot width SW2 is substantially constant for the first portion of the slot 204 defining a preferred width of about 0.08 inch. The constant width portion of the slot 204 is preferably radially outward with respect to the second portion of the slot having in which the slot width SW2 varies. More particularly for the preferred second asymmetric slot 204, the slot width SW2 is initially substantially constant over the second segment of the first sidewall 204*a* to define a preferred slot width SW2 of about 0.1 inch and then varies over the first and third segments of the first sidewall 204*a* radially inward of the second segment of the sidewall 204*a*.

Referring to FIG. 4A, disposed between the first and second asymmetric slots 202, 204 is the third group of asymmetric slots 206 and contiguously formed with the asymmetric tines 116'*b*, 118'*b*. The third asymmetric slot 206 includes a slot open end 210*c* at the peripheral edge 106 and a closed end 212*c* disposed radially inward of the open end 210*c*. The closed end 212*c* defines the radially innermost portion of the slot 206 disposed at a preferred radial distance R3 from the center C of the deflector 100 of about ⅓ inch and is more preferably about 0.34 inch. Extending between the open and closed ends 210*c*, 212*c* are the first sidewall 206*a* and second sidewall 206*b* of the asymmetric slot 206, which respectively correspond to the outer edges of the asymmetrical tines 116'*b*, 118'*b*. The first and second sidewalls 206*a*, 206*b* are spaced apart and define one or more angles with respect to the axes of symmetry to define the profile of the asymmetric slot 206 and the slot width SW3 over the length of the slot. In the preferred embodiment of the asymmetric slot 206, the first sidewall 206*a* defines a first substantially constant included angle α2 with respect to the first axis of symmetry S1-S1 over a first portion of the length of the slot 206 and a substantially constant included second angle α3 different from the first substantially constant included angle α2. The first angle α2 more preferably defines an angle ranging between about forty to about forty-five degrees (40°-45°) and even more preferably about 42° with respect to the first axis of symmetry S1-S1. The second angle α3 preferably defines an angle of about 20° with respect to the first axis of symmetry S1-S1. The second sidewall 206*b* preferably includes a first segment that extends substantially parallel to the first segment of the first sidewall 206*a* and a second segment that defines a third angle β2 to the second axis of symmetry S2-52. The first segment preferably extends outwardly from the slot closed end 212*c* preferably to the second segment of the second sidewall 206*b*. The third angle β2 to the second axis of symmetry S2-S2 is preferably constant from the first segment to the peripheral edge 106 and defines a preferred included angle β2 of about thirty degrees. Accordingly for the preferred slot 206, the slot width SW3 is substantially constant for the first portion of the slot 206 defining a preferred width of about 0.1 inch and more preferably 0.09 inch. The constant width portion of the slot 206 is preferably radially inward with respect to the second portion of the slot in which the slot width SW3 varies. The deflector 400 provides for a quadrant of the deflector having a slot preferably disposed at about the 45 degree angle relative to the quadrant defining axes S1-S1, S2-S2.

The deflector member 400 may be mounted to the sprinkler frame 12 such that the second axis of symmetry S2-S2 is disposed in a plane P which bisects the frame 12 and more preferably is equidistantly disposed between the frame arms 22*a*, 22*b*. Accordingly, for the preferred sprinkler assembly 10, the second pair of symmetric tines 114'*a*, 114'*b* extend normal to the sprinkler frame window W defined by the frame arms 22*a*, 22*b*. Thus, for the preferred sprinkler assembly 10, the first axis of symmetry S1-S1 and first group of symmetric tines 112'*a*, 112'*b* are aligned orthogonally to the plane P and substantially in a direction toward the frame arms 22*a*, 22*b*.

The preferred sprinkler frame 12 further preferably defines a discharge coefficient with a nominal K-factor of about 25.2 GPM/$(PSI)^{1/2}$ and a preferred outlet-to-deflector distance of about 1¼ inch, and more particularly at an outlet-to-deflector distance of 1.27 inches. The combination of the preferred outlet-to-deflector distance and the preferred deflector diameter provides for an overall compact sprinkler assembly. Where not expressly provided, any embodiment of the preferred deflector can include one or more features of the other described deflecting members or structures. Thus it should be understood, for example, that any tine or portion thereof can includes one or more features of tine width, length or outer edges configuration to define of any one of more of a slot configuration, tine geometry, tine pattern, tine symmetry, tine asymmetry or angular relation to the axes of symmetry previously described to provide for a desire deflector arrangement.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A sprinkler comprising:

a frame having a body having an inlet, an outlet and an internal passageway extending between the inlet and the outlet to define a longitudinal sprinkler axis, the frame including two frame arms extending distally from the body about the outlet to define a plane bisecting the body such that the arms are equidistantly disposed about the plane; and a planar fluid deflecting structure supported by the frame arms, the fluid deflecting structure having a center aligned along the longitudinal sprinkler axis, a first peripheral edge defining a first diameter of the deflecting structure about the center, and a second peripheral edge defining a second diameter of the deflecting structure about the center, the second diameter being greater than the first diameter, the deflecting structure having a plurality of tines including:

a first symmetrical tine defining a first axis of symmetry disposed in the plane;

a second symmetrical tine defining a second axis of symmetry disposed orthogonally with respect to the first axis of symmetry, each of the first and second symmetrical tines includes a first portion having a constant width in a first direction normal to the axis of symmetry of the tine and the longitudinal sprinkler axis and a second portion having a variable width in a second direction normal to the axis of symmetry of the tine and the longitudinal sprinkler axis such that the second portion broadens in the direction from the center to one of the first and second peripheral edges, the second portion of each of the first and second symmetrical tines includes an outer edge having a first segment defining a first configuration with respect to the first and second axes of symmetry and a second segment defining a second configuration with respect to the first and second axes of symmetry that is different than the first configuration; and an asymmetric slot radially disposed between the first and second symmetrical tines, the asymmetric slot includes an open end, a closed end defining a radially innermost portion of the slot, and a pair of spaced apart sidewalls extending from the closed end to the open end, each sidewall includes a first segment defining a first angle with respect to the first and second axes of symmetry and at least a second segment defining a second angle different than the first angle with respect to the first and second axes of symmetry such that the asymmetric slot broadens in a direction from the closed end to the open end.

2. The sprinkler of claim 1, wherein in the outer edge of the second portion of the first symmetric tine, the first segment defines a first radius of curvature and the second segment defines a second radius of curvature so as to define an inflection point therebetween; wherein in the outer edge of the second portion of the second symmetric tine, the first segment defines a first included angle with respect to the second axis of symmetry and the second segment defines a second included angle with respect to the second axis of symmetry that is different than the first angle.

3. A sprinkler comprising:

a frame having a body having an inlet, an outlet and an internal passageway extending between the inlet and the outlet to define a longitudinal sprinkler axis, the frame including two frame arms extending distally from the body about the outlet to define a plane bisecting the body such that the arms are equidistantly disposed about the plane; and a planar fluid deflecting structure supported by the frame arms, the fluid deflecting structure having a center aligned along the longitudinal sprinkler axis and a peripheral edge about the center, the peripheral edge including a first peripheral edge and a second peripheral edge, the deflecting structure having a plurality of tines including:

a first symmetrical tine defining a first axis of symmetry disposed in the plane;

a second symmetrical tine defining a second axis of symmetry disposed orthogonally with respect to the first axis of symmetry, each of the first and second symmetrical tines includes a first portion having a constant width in a first direction normal to the axis of symmetry of the tine and the longitudinal sprinkler axis and a second portion having a variable width in a second direction normal to the axis of symmetry of the tine and the longitudinal sprinkler axis such that the second portion broadens in the direction from the center to one of the first and second peripheral edges, the second portion of each of the first and second symmetrical tines includes an outer edge having a first segment defining a first configuration with respect to the first and second axes of symmetry and a second segment defining a second configuration with respect to the first and second axes of symmetry that is different than the first configuration; and an asymmetric slot radially disposed between the first and second symmetrical tines, the asymmetric slot includes an open end, a closed end defining a radially innermost portion of the slot, and a pair of spaced apart sidewalls extending from the closed end to the open end, each sidewall includes a first segment defining a first angle with respect to the first and second axes of symmetry and at least a second segment defining a second angle different than the first angle with respect to the first and second axes of symmetry such that the asymmetric slot broadens in a direction from the closed end to the open end.

4. The sprinkler of claim 3, wherein in the first configuration, the outer edge of the second portion of the first symmetric tine defines a first radius of curvature; and wherein in the second configuration, the outer edge of the second portion of the first symmetric tine defines a second radius of curvature so as to define an inflection point therebetween.

5. The sprinkler of claim 3, wherein in the first configuration, the outer edge of the second portion of the second symmetric tine has a first segment defining a first included angle with respect to the second axis of symmetry and wherein in the second configuration, the outer edge of the second portion of the second symmetric tine has a second segment defining a second included angle with respect to the second axis of symmetry that is different than the first angle.

6. A sprinkler comprising:

a frame having a body having an inlet, an outlet and an internal passageway extending between the inlet and the outlet to define a longitudinal sprinkler axis, the frame including two frame arms extending distally about the outlet to define a plane bisecting the body with the longitudinal axis disposed in the plane; and a planar fluid deflecting structure supported by the frame arms, the fluid deflecting structure having a center aligned along the longitudinal sprinkler axis and a peripheral edge including a first peripheral edge defining a first diameter of the deflecting structure about the center and a second peripheral edge defining a second diameter of the deflecting structure about the center, the second diameter being greater than the first diameter, the deflecting structure including a plurality of tines including a first pair of symmetrical tines defining a first axis of symmetry disposed in the plane;

a second pair of symmetrical tines defining a second axis of symmetry disposed orthogonally with respect to the first axis of symmetry, each of the first and second pairs of symmetrical tines includes a first portion having a constant width in a first direction normal to the axis of symmetry of the tine and the longitudinal sprinkler axis and a second portion having a variable width in a second direction normal to the axis of symmetry of the tine and the longitudinal sprinkler axis such that the second portion broadens in the direction from the center to one of the first and second peripheral edges, the second portion of each of the first and second symmetrical tines includes an outer edge having a first segment defining a first configuration with respect to the first and second axes of symmetry and a second segment defining a second configuration with respect to the first and second axes of symmetry that is different than the first configuration; and two pairs of asymmetric tines angularly disposed between the first and second pairs of symmetric tines, the two pairs of asymmetric tines being radially adjacent to one another to define an asymmetric slot therebetween, the asymmetric slot having a first portion with a constant width and a second portion with a variable width radially outward of the first portion of the slot.

7. The sprinkler of claim 6, wherein the deflecting structure includes a central opening disposed about a distal terminal portion of the frame the first portion in at least one tine of the first pair of symmetrical tines having a first end disposed between the first peripheral edge and the central opening and a second end disposed between the first end of the at least one tine in the first pair of symmetrical tines and the central opening to define a length of the first portion of the at least one tine in the first pair of symmetrical tines, the first portion in at least one tine of the second pair of symmetrical tines having a first end disposed between the second peripheral edge and the central opening and a second end disposed between the first end of the at least one tine in the second pair of symmetrical tines and the central opening to define a length of the first portion of the at least one tine in the second pair of symmetrical tines, the length of the first portion of the at least one tine in the second pair of symmetrical tines being less than the length of the first portion of the at least one tine in the first pair of symmetrical tines.

8. The sprinkler of claim 6, wherein the asymmetrical slot includes an open end and a closed end, a pair of spaced apart sidewalls extending from the closed end to the open end, at least one sidewall of the pair of sidewalls including a first segment defining a first included angle with respect to the second axis of symmetry, and a second segment defining a second included angle with respect to the second axis of symmetry, the second included angle being less than the first included angle.

9. The sprinkler of claim 6, wherein the asymmetric slot is a first asymmetric slot disposed between a second asymmetric slot and a third asymmetric slot, the second and third asymmetric slots each having a first portion with a constant width and a second portion with a variable width radially inward of the first portion of the slot.

10. The sprinkler of claim 6, wherein the second portion of each tine of the first pair of symmetrical tines includes an outer edge having a first radius of curvature and a second radius of curvature so as to define an inflection point therebetween.

11. A sprinkler comprising:

a frame having a body having an inlet, an outlet and an internal passageway extending between the inlet and the outlet to define a longitudinal sprinkler axis, the frame including two frame arms extending distally from the body about the outlet to define a plane bisecting the body such that the arms are equidistantly disposed about the plane; and a planar fluid deflecting structure installed on the frame arms, the fluid deflecting structure having a central circular opening defining a center aligned along the longitudinal sprinkler axis and a peripheral edge about the center, the planar fluid deflecting structure having a first surface opposed to the outlet and a second surface opposite the first surface, each of the first and second surfaces being perpendicular to the sprinkler axis from the peripheral edge to the central circular opening, the deflecting structure including a plurality of spaced apart tines defining a plurality of slots including a first pair of symmetrical tines defining a first axis of symmetry disposed in the plane, each of the first pair of symmetrical tines having an outer edge between the center and the peripheral edge that defines a first radius of curvature and a second radius of curvature between the center and the peripheral edge so as to define an inflection point between the first and second radius of curvature;

a second pair of symmetrical tines defining a second axis of symmetry disposed orthogonally with respect to the first axis of symmetry; and three groups of asymmetric slots angularly disposed between the first and second pairs of symmetrical tines, the three groups of asymmetric slots including a first group of asymmetric slots having a first portion with a constant width and a second portion with a variable width radially outward of the first portion of the slot, the first group being radially disposed between a second and third group of asymmetric slots, each of the second and third groups of slots having a first portion with a constant width and a second portion with a variable width radially inward of the first portion of the slot.

12. The sprinkler of claim 11, wherein each pair of symmetrical tines includes a first portion having a constant width and a second portion radially outward of the first portion having a variable width such that the second portion broadens in the radial outward direction.

13. The sprinkler of claim 11, wherein the second portion of the second pair of symmetrical tines includes an outer edge having a first segment defining a first included angle with respect to the second axis of symmetry and a second segment defining a second included angle with respect to the second axis of symmetry that is less than the first angle.

14. The sprinkler of claim 11, wherein each of the asymmetric slots includes an open end and a closed end defining the radially innermost portion of the slot, wherein the closed end of at least one of the second and third groups of asymmetric slots is more radially inward than the closed end of the first group of asymmetric slots.

15. The sprinkler of claim 11, wherein each of the asymmetric slots includes an open end, a closed end defining the radially innermost portion of the slot, and a pair of spaced apart sidewalls extending from the closed end to the open end, wherein one sidewall of the second group of asymmetric slots is defined by an outer edge of the first pair of symmetric tines and wherein one sidewall of the third group of asymmetric slots is defined by an outer edge of the second pair of symmetric tines, the pair of sidewalls of the first group of asymmetric slots each includes a first segment extending parallel to one another to define a first included angle with respect to the second axis of symmetry, the pair of sidewalls of the first group of asymmetric slots each including a second segment defining a second included angle with respect to the second axis of symmetry, the second included angle of each sidewall in the pair of sidewalls of the first group of asymmetric slots being different than the first included angle.

16. A sprinkler comprising:

a frame having a body having an inlet, an outlet and an internal passageway extending between the inlet and the outlet to define a longitudinal sprinkler axis, the frame including two frame arms extending distally from the body about the outlet to define a plane bisecting the body such that the arms are equidistantly disposed about the plane;

and a planar fluid deflecting structure installed on the frame arms, the fluid deflecting structure having a central circular opening defining a center aligned along the longitudinal sprinkler axis and a peripheral edge about the center, the planar fluid deflecting structure having a first surface opposed to the outlet and a second surface opposite the first surface, each of the first and second surfaces being perpendicular to the sprinkler axis from the peripheral edge to the central circular opening, the deflecting structure including a plurality of spaced apart tines including:

a first pair of symmetrical tines defining a first axis of symmetry disposed in the plane, each of the first pair of symmetrical tines having an outer edge between the center and the peripheral edge that defines a first radius of curvature and a second radius of curvature between the center and the peripheral edge so as to define an inflection point between the first and second radius of curvature; and a second pair of symmetrical tines defining a second axis of symmetry disposed orthogonally with respect to the first axis of symmetry; and further comprising an asymmetric slot angularly disposed between one tine of the first symmetric pair and one tine of the second symmetric pair, the asymmetric slot having a closed end, an open end and a pair of spaced apart sidewalls extending from the closed end to the open end, wherein each sidewall includes a first segment defining a first angle with respect to the first and second axes of symmetry and at least a second segment defining a second angle different than the first angle with respect to the first and second axes of symmetry such that the asymmetric slot broadens in a direction from the closed end to the open end, the pair of sidewalls including a first sidewall and a second sidewall, the first segment of the first sidewall defines a first substantially constant included angle with respect to the first axis of symmetry over the length of the first segment of the first sidewall and the second segment of the first sidewall defines a second substantially constant included angle different from the first substantially constant included angle with respect to the first axis of symmetry over the length of the second segment of the first sidewall, the first included angle of the first segment of the first sidewall ranging between about forty to about forty-five degrees with respect to the first axis of symmetry S1-S1, the second included angle of the second segment of the first sidewall being about 20° with respect to the first axis of symmetry, the first segment of the second sidewall extends substantially parallel to the first segment of the first sidewall and the second segment of the second sidewall defines a third included angle with respect to the second axis of symmetry of about thirty degrees.

17. The sprinkler of claim 16, wherein the peripheral edge includes a first peripheral edge defining a first diameter of the deflecting structure about the center, and a second peripheral edge defining a second diameter of the deflecting structure about the center, the second diameter being greater than the first diameter.

18. A sprinkler comprising:

a frame having a body having an inlet, an outlet and an internal passageway extending between the inlet and the outlet to define a longitudinal sprinkler axis, the frame including two frame arms extending distally from the body about the outlet to define a plane bisecting the body such that the arms are equidistantly disposed about the plane; and a planar fluid deflecting structure supported by the frame arms, the fluid deflecting structure having a center aligned along the longitudinal sprinkler axis and a peripheral edge about the center, the peripheral edge including a first peripheral edge and a second peripheral edge, the deflecting structure having a plurality of tines including:

a first pair of symmetrical tines defining a first axis of symmetry disposed in the plane;

a second pair of symmetrical tines defining a second axis of symmetry disposed orthogonally with respect to the first axis of symmetry, each of the tines in the first and second symmetrical pairs of tines includes a first portion having a constant width in a first direction normal to the axis of symmetry of the tine and the longitudinal sprinkler axis and a second portion spaced outward from the first portion and having a variable width in a second direction normal to the axis of symmetry of the tine and the longitudinal sprinkler axis such that the second portion broadens in the direction from the center to one of the first and second peripheral edges, the second portion in each of the first and second pairs of symmetrical tines includes an outer edge having a first segment defining a first angle with respect to the first and second axes of symmetry and a second segment defining a second angle with respect to the first and second axes of symmetry that is different than the first angle; and an asymmetric slot angularly disposed between one tine of the first pair of symmetrical tines and one tine of the second pair of symmetrical tines.

19. The sprinkler of claim 18, wherein the asymmetric slot has a closed end, an open end and a pair of spaced apart sidewalls extending from the closed end to the open end, wherein each sidewall includes a first segment defining a first angle with respect to the first and second axes of symmetry and at least a second segment defining a second angle different than the first angle with respect to the first and second axes of symmetry such that the asymmetric slot broadens in a direction from the closed end to the open end, the pair of sidewalls including a first sidewall and a second sidewall, the first segment of the first sidewall defines a first substantially constant included angle with respect to the first axis of symmetry over the length of the first segment of the first sidewall and the second segment of the first sidewall defines a second substantially constant included angle different from the first substantially constant included angle with respect to the first axis of symmetry over the length of the second segment of the first sidewall, the first included angle of the first segment of the first sidewall ranging between about forty to about forty-five degrees (40°-45°) with respect to the first axis of symmetry, the second included angle of the second segment of the first sidewall being about 20° with respect to the first axis of symmetry, the first segment of the second sidewall extends substantially parallel to the first segment of the first sidewall and the second segment of the second sidewall defines a third included angle with respect to the second axis of symmetry of about thirty degrees.

* * * * *